US010993492B1

(12) United States Patent
Koen

(10) Patent No.: US 10,993,492 B1
(45) Date of Patent: May 4, 2021

(54) UNDERGARMENT WITH MODULAR CONNECTING SYSTEM

(71) Applicant: Tamara & Bernadette Designs LLC, New York, NY (US)

(72) Inventor: Tamara Koen, New York, NY (US)

(73) Assignee: TAMARA & BERNADETTE DESIGNS LLC, New York, NY (US)

( * ) Notice: Subject to any disclaimer, the term of this patent is extended or adjusted under 35 U.S.C. 154(b) by 0 days.

(21) Appl. No.: 16/823,134

(22) Filed: Mar. 18, 2020

(51) Int. Cl.

| | |
|---|---|
| ***A41F 5/00*** | (2006.01) |
| ***A41F 11/06*** | (2006.01) |
| ***A41F 11/18*** | (2006.01) |
| ***A41F 1/08*** | (2006.01) |
| ***A41B 1/06*** | (2006.01) |
| ***A41F 11/16*** | (2006.01) |
| ***A41F 11/14*** | (2006.01) |
| ***A41F 17/00*** | (2006.01) |
| ***A41B 9/08*** | (2006.01) |
| ***A44B 11/00*** | (2006.01) |

(52) U.S. Cl.
CPC ..... *A41F 5/00* (2013.01); *A41B 1/06* (2013.01); *A41B 9/08* (2013.01); *A41F 1/08* (2013.01); *A41F 11/06* (2013.01); *A41F 11/14* (2013.01); *A41F 11/16* (2013.01); *A41F 11/18* (2013.01); *A41F 17/00* (2013.01); *A44B 11/006* (2013.01); *Y10T 24/3432* (2015.01)

(58) Field of Classification Search
CPC .... A41F 5/00; A41F 1/08; A41F 17/00; A41F 11/14; A41F 11/06; A41F 11/18; A41F 11/16; A41B 9/08; A41B 1/06; Y10T 24/3432; Y10T 24/3431; Y10T 24/3412–3413; Y10T 24/3427–3465; A44B 11/006; A44B 11/06; A44B 11/065
See application file for complete search history.

(56) References Cited

U.S. PATENT DOCUMENTS

| | | | | |
|---|---|---|---|---|
| 613,816 | A * | 11/1898 | Harrison | A41B 7/04 24/44 |
| 1,102,759 | A | 7/1914 | Keifer | |
| 2,126,905 | A | 8/1938 | Englander | |
| 2,352,147 | A * | 6/1944 | Clark | A41B 13/08 24/329 |
| 2,727,247 | A | 12/1955 | Thelma | |
| 4,074,364 | A | 2/1978 | Lucero | |
| 4,425,690 | A * | 1/1984 | Fraser | A44B 99/00 24/351 |
| 4,596,569 | A | 6/1986 | Campbell | |
| 4,853,979 | A | 8/1989 | Ryder | |

(Continued)

OTHER PUBLICATIONS

PCT Search Report and Written Opinoin issued in PCT Application No. PCT/US18/50567 dated Nov. 28, 2018, 14 pages.

*Primary Examiner* — Khaled Annis
(74) *Attorney, Agent, or Firm* — Weber Rosselli & Cannon LLP

(57) ABSTRACT

An undergarment including a front panel having a top edge, an elastic band arranged on the front panel along the top edge and extending beyond the front panel parallel to the top edge. The undergarment further includes a back panel having a top edge, the elastic band arranged on the back panel along the top edge and extending beyond the back panel parallel to the top edge, and a pair of connectors secured to the elastic band and configured to attach to a side seam of a blouse or shirt.

20 Claims, 9 Drawing Sheets

(56) References Cited

U.S. PATENT DOCUMENTS

| | | | | |
|---|---|---|---|---|
| 4,937,886 | A * | 7/1990 | Ellis | A41F 17/00 2/323 |
| 5,012,802 | A | 5/1991 | Bischoff | |
| 5,177,813 | A | 1/1993 | Bosack et al. | |
| 5,177,814 | A | 1/1993 | Courtney | |
| 5,276,923 | A | 1/1994 | Cohen | |
| 5,640,742 | A * | 6/1997 | White | A44C 3/001 24/18 |
| 7,243,402 | B2 * | 7/2007 | Andersen | B60P 7/0807 24/517 |
| 7,441,424 | B2 * | 10/2008 | Saitoh | E05B 73/0017 24/303 |
| D611,678 | S | 3/2010 | Bailey | |
| 8,176,965 | B1 * | 5/2012 | Motosko | E06B 9/0692 160/328 |
| 8,342,575 | B2 * | 1/2013 | Coleman | A63C 5/16 24/298 |
| 8,601,615 | B2 | 12/2013 | Isaacson et al. | |
| D738,070 | S | 9/2015 | Koen | |
| 10,165,815 | B1 | 1/2019 | Branker et al. | |
| 2015/0020352 | A1 * | 1/2015 | Funger | A47C 21/022 24/301 |
| 2015/0040285 | A1 | 2/2015 | Mobayyen | |
| 2015/0089718 | A1 | 4/2015 | Pluta | |

* cited by examiner

UNDERGARMENT WITH MODULAR CONNECTING SYSTEM

FIELD

This disclosure relates to the field of clothing and particularly to undergarments to secure shirts and blouses such that they are prevented from pulling out of pants and skirts of the wearer.

BACKGROUND

A smooth, flat shirtfront with the shirt fully retained within a waistband of a wearer's pants or skirt presents a sleek, well-groomed, and professional appearance. Conversely, a shirttail sticking out of the waistband or with a puckered shirtfront is generally considered sloppy and undesirable. Indeed, many professions and organizations, including policemen, military personnel, airline personnel, front desk hotel personnel, waitresses and others require that the personnel maintain a highly professional appearance with their shirts tucked in even while being engaged in highly active requirements of their profession.

Shirts have a tendency over time to escape from the waistband. If the wearer is very active and moves around a lot, the shirttail naturally moves with the top of the torso and pulls out of the waistband, and even sitting can be the cause of movement of the shirt relative to the wearer.

While many solutions have been proposed to regain the shirt or blouse in a wearer's pants and skirts, none of these have proven satisfactory or experienced wide adoption despite the large population of who would benefit from such a device. First, many of the known systems require attachment around both legs, which can be uncomfortable to the wearer and cause chafe. Another major drawback that limit adoption of the existing devices is that they tend to create visible lines that can be seen under the wearer's pants or skirt or generate creases in the shirts they are seeking to secure. This visibility largely defeats the goal of creating a professional appearance. In part, this visibility, particularly in the rear, is caused because the systems are designed to attach to the shirt tails (i.e., the front and back of the shirt or blouse.) In sum, though many attempts have been made to create a device to secure shirts within a wearer's pants or skirt these configurations have proven to be generally ineffective, uncomfortable, inconvenient, and self-defeating of the desire to present a professional and sleek appearance. Indeed, one well-known undergarment manufacturer has proposed an undergarment having generally three elongate members. Two of these elongate members connect to the front of the wearer's shirt, and the third to the back and are connected at a point under the wearer's pelvis. As can be imagined, such a device has proven to be quite uncomfortable to the wearer. The discomfort associated with this device has prevented its wide adoption. Further, because the elongate members are designed to connect to the front and back of the wearer's shirt, in addition to being uncomfortable, the devices are ineffective in generating the desired professional appearance and instead creating creases and other undesirable effects in the wearer's clothing.

Another option that has been shirts and blouses that are bodysuits which are kept comfortably in place and neatly tucked into a wearer's pants or skirt by virtue of its "unitard" design. Body suits can be made with or without with or without a crotch closure. The bodysuit, however, has limits in its overall design of the blouse or shirt and may not be permissible for may professions that require the sleek and professional look described above.

This disclosure is directed to overcoming the shortcomings of the known systems.

SUMMARY

One aspect of the disclosure is directed an undergarment including: a front panel having a top edge, an elastic band arranged on the front panel along the top edge and extending beyond the front panel parallel to the top edge, a back panel having a top edge, the elastic band arranged on the back panel along the top edge and extending beyond the back panel parallel to the top edge, and a pair of connectors secured the elastic band and configured to attach to a side seam of a blouse or shirt.

In the undergarment, the elastic band may be configured to extend from the front panel and across a thigh of a wearer substantially parallel to the top edge of the front panel. The elastic band may be configured to extend from the back panel and under the buttocks of a wearer. The undergarment may include a connection point, where the front and back panels connect to each other. The front and back panels may be integrally formed in a one-piece construction. The front panel may be shaped to comfortably receive male genitalia. The elastic band may be formed of a first elastic band extending from the front panel and a second elastic band extending from the back panel. Each of the first and second elastic bands may include at least one length adjuster. The front and back panels may be configured for comfortable placement between the legs of a wearer. The front and back panels may be substantially trapezoidal shaped. The front and back panels are integrally formed may be a substantially hourglass shaped one-piece construction. The connectors may be clasp type connectors. The connectors may be double clasp type connectors. The connector may include a first clasp configured to be secured to a shirt, and a second clasp configured to be secured to the elastic band. The closure of the first clasp simultaneously closes the second clasp.

Another aspect of the disclosure is an undergarment including: a front panel having a top edge; an elastic band arranged on the front panel along the top edge and extending beyond the front panel parallel to the top edge; a back panel having a top edge; the elastic band arranged on the back panel along the top edge and extending beyond the back panel parallel to the top edge; and a pair of dual clasp connectors secured the elastic band and configured to attach to a side seam of a blouse or shirt, and including. The undergarment also includes a continuous band clamp including an upper shirt clamp half, a lower shirt clamp half and a spring. The undergarment also includes an undergarment clamp including an upper undergarment clamp half and a lower undergarment clamp half. The undergarment also includes a strut formed on the continuous band clamp and configured to rigidly support the lower undergarment clamp half and to receive the upper undergarment clamp half in a hole formed in the strut. The undergarment also includes a tang extending from the upper undergarment clamp half, where rotation of the upper undergarment clamp half in the hole in a direction towards the lower undergarment clamp half forces the tang against the upper shirt clamp half forcing the upper shirt clamp half in the direction of the lower shirt clamp half closing the continuous band clamp and the undergarment clamp.

In the undergarment the elastic band may be configured to extend from the front panel and across a thigh of a wearer substantially parallel to the top edge of the front panel. The elastic band may be configured to extend from the back panel and under the buttocks of a wearer. The front and back panels may be integrally formed in a one-piece construction.

A further aspect of the disclosure is a dual clasp connector including: a continuous band clamp including an upper shirt clamp half, a lower shirt clamp half and a spring; an undergarment clamp including an upper undergarment clamp half and a lower undergarment clamp half; a strut formed on the continuous band clamp and configured to rigidly support the lower undergarment clamp half and to receive the upper undergarment clamp half in a hole formed in the strut; and a tang extending from the upper undergarment clamp half, where rotation of the upper undergarment clamp half in the hole in a direction towards the lower undergarment clamp half forces the tang against the upper shirt clamp half forcing the upper shirt clamp half in the direction of the lower shirt clamp half closing the continuous band clamp and the undergarment clamp.

BRIEF DESCRIPTION OF THE DRAWINGS

Various exemplary embodiments are illustrated in the accompanying figures. It will be appreciated that for simplicity and clarity of the illustration, elements shown in the figures referenced below are not necessarily drawn to scale. Also, where considered appropriate, reference numerals may be repeated among the figures to indicate like, corresponding or analogous elements. The figures are listed below.

DETAILED DESCRIPTION

The disclosure is directed to a system and device for securing a wearer's shirt within their pants or skirt. The undergarments of the disclosure attach to any and all blouses and shirts via modular connecting system, creating infinite opportunities to covert the blouses and shirts into customized bodysuits.

In accordance with one aspect of the disclosure undergarment includes front and back panels (attached in the middle with snaps, hooks, a gusset, or other fasteners or formed as one continuous piece. These panels have been carefully designed to be comfortably placed under the crotch of a wearer, with specific front and back panel placement. Both front and back panels may include an adjustable elasticized band with clips located at the end of the band and the elasticized band strategically attached to the front and back panels along a top edge of each of the front and back panels respectively.

Figure 1:
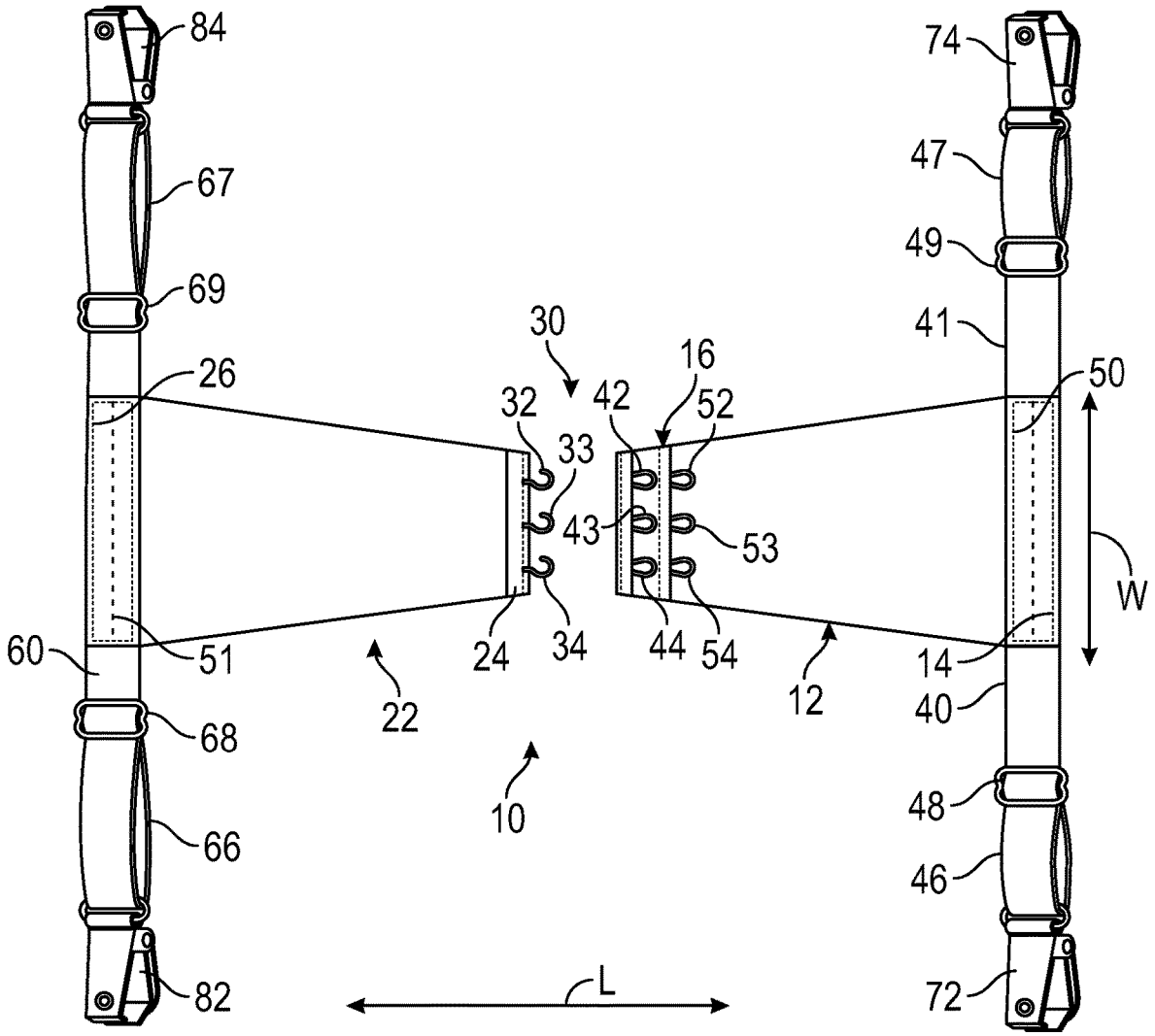
FIG. 1 is a schematic diagram of an undergarment in accordance with the present disclosure.

FIG. 1 is a schematic view of an embodiment of an undergarment 10 in accordance with aspects of the present disclosure. A front panel 12 of the undergarment 10 has a top edge 14 and a bottom edge 16. A rear panel 22 has a bottom edge 24 and a top edge 26. Bottom edge 24 of the rear panel 22 is removably attachable to the bottom edge 16 of the front panel 12 via a detachable connection 30. As depicted in FIG. 1 three hooks 32, 33, 34 formed on the rear panel 22 are placed proximate the bottom edge 24 and spaced to mate with and three loops 42, 43, 44 formed proximate the bottom edge 16 of the front panel 12. A second set of loops 52, 53, 54 may also be provided on the front panel 12 at a different distance from the bottom edge 16 to allow for different overall lengths in the longitudinal direction L when connected to the hooks 32, 33, 34.

In one aspect of the disclosure, hooks 32, 33, 34, and loops 42, 43, 44, 52, 53, 54 are formed of a rigid material such as metal or hard plastic. The connection of the hooks 32, 33, 34 to the loops 42, 43, 44 is in a manner like that employed for a bra or other undergarments. As alternatives the front panel 12 and rear panel 22 may connect to one another with snaps, hook-and-loop fasteners, buttons, or other connections components known to those of ordinary skill in the art.

A front elastic band 40 is connected to the front panel 12 such that it extends in a direction W that is substantially perpendicular to the longitudinal direction L. The front elastic band 40 may be connected via stitching 50 along the top edge 14 of the front panel 12. Alternative methods of connection are also contemplated including hook and loop fasteners, clasps, and others without departing from the scope of the present disclosure. Further, though shown as a continuous band, the front elastic band 40 may be formed of two separate elastic bands (40, 41) connected to the front panel 12 and extending from the front panel 12 in opposite directions.

As shown in FIG. 1 the front panel 12 and the rear panel 22 have a generally trapezoidal shape, however, the disclosure is not so limited. The front and rear panels can have other shapes and may include curves or other features to enhance the comfort of the wearer. Further the front and rear panel may be formed to ergonomically be received between the legs of the wearer and have a substantially hourglass shape when combined. Still further, as detailed below, the front and back panels may be integrally formed in a once-piece construction (see e.g., FIGS. 11A and 11B).

Figure 8:
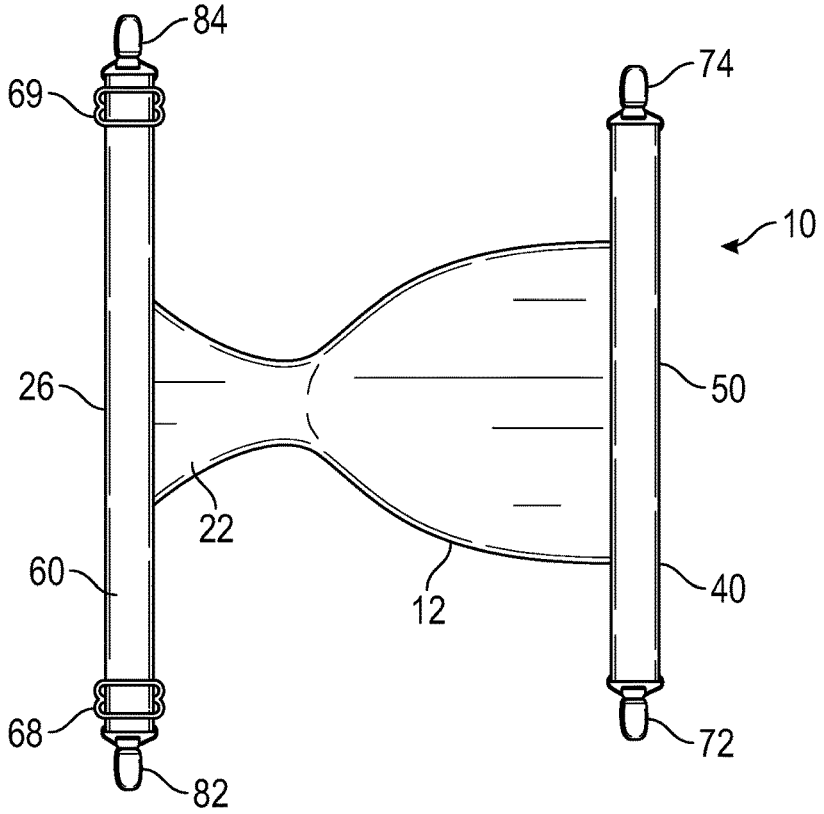
FIG. 8 is a plan view of an undergarment configured to be worn by a man in accordance with the disclosure.

Like the description of the front panel 12, above, an elastic read band 60 extends from the rear panel 22 in the direction W. The elastic rear band 60 is connected via stitching 51 proximate the top edge 26 of the rear panel 22. In one embodiment, rear panel 22 has a greater dimension in the L direction than front panel 12. In another embodiment, front panel 12 has a greater dimension in the L direction than rear panel 22 (as shown in FIG. 8). This may provide a better fit for some body types. The width of both front panel 12 and rear panel 22 in a direction W generally is less than the respective panel length in L direction. Further, as noted above, while the front and rear panels 12 and 22, need not be generally trapezoidal, they will generally have a smaller width (dimension in the W direction) at the detachable connection 30, than they have at the top edges 14 and 26. Further, the width of over the front panel 12 and rear panel 22 is generally less than their length (dimension in the L direction).

Both elastic front band 40 and elastic rear band 60 may include one or more adjusters 48, 49, 68, 69 along their length. The adjusters allow for change in effective length of the elastic band in the W direction. The front elastic band 40 and rear elastic band 60 loops back through the adjusters 48, 49, and 68, 69 to form end loops, 46, 47, 66, 77 respectively. End loops 46, 47, 66, 67 are adjustable individually.

Connectors 72, 74, 82, 84 are located at distal ends of the front elastic band 40 and rear elastic band 60. The connectors can be for example a clasp which can be closed to secure the material of a shirt or a blouse between two opposing faces of the clasp, as shown. Alternatively, the connector may include an opening into which a portion of the shirt or blouse is placed, and second portion is forced into the opening to secure the portion of the shirt or blouse therein. As will be appreciated, it will be desirable that the connectors have a low profile that will not be visible.

Placement of the elastic front band 40 and rear band 60 perpendicular to the longitudinal direction L is deliberate and necessary for proper function of the undergarment 10. Attachment of the connectors 72, 74, 82, and 84 to a shirt or blouse is to be at or near the side seams of the blouse or shirt to properly hold the shirt in place. It is the side seams at the arm hole of the shirt that begins to pull the shirt out of place, particularly when the wearer raises their arms or even moves their arms naturally while walking. Additionally, the attachment at the side seams eliminates the variability of length of shirt tails as the shirt tails are not the attachment point of the undergarment as described in greater detail below. Indeed, for reasons explained with reference to FIG. 2, it is not desirable to attach the elastic front band 40 and rear band 60 to the shirt tails for firm and comfortable hold of shirt or blouse.

Figure 2:
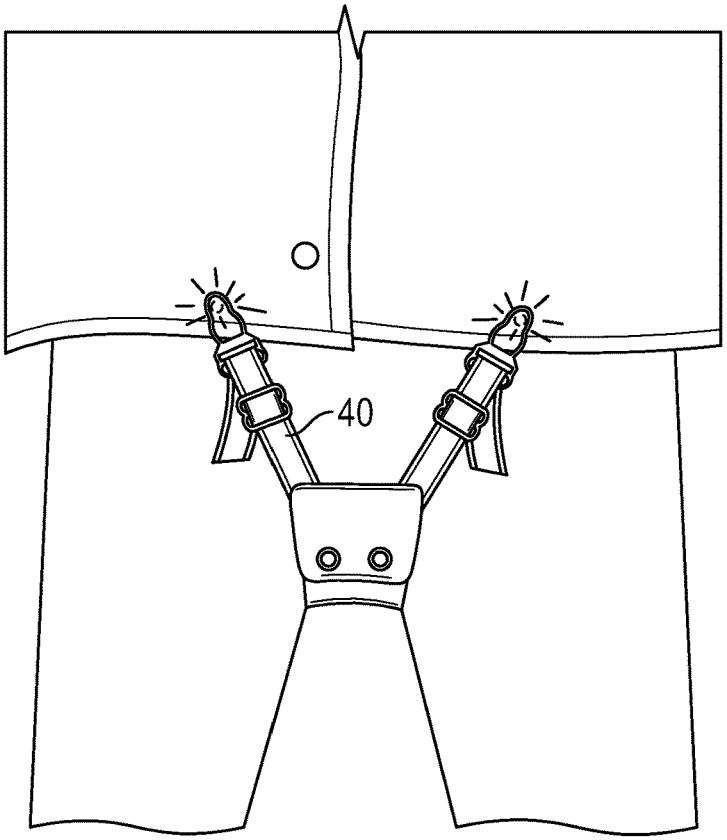
FIG. 2 is a known undergarment system.

FIG. 2 is a known device for securing a shirt or blouse in position. While there are some passing similarities between what is shown in FIG. 1 of this disclosure and the known device, the differences are in fact significant and render the device of FIG. 2 incapable of securely retaining a shirt or blouse within the wearer's pants or skirt. The primary issue with prior designs, as depicted for example in FIG. 2 is that the bands 40 which extend from crotch piece extend vertically from or at oblique angles to a top edge of the crotch piece. As noted above, these angles, make the bands 40 visible, particularly on the rear of the wearer. In practice, the bands will rest vertically on the wearer's buttocks and when wearing a tight skirt or pants will create quite visible lines in the fabric of the pants or skirt. Further, these bands are designed and sized to clasp onto the front and back of the shirt (as shown). This is problematic as it will not prevent the sides of the shirt from escaping the waist band of the pants or skirt, particularly as the wearer stretches their arms overhead or engages in other more strenuous activity. Still further, this connection on the front and back of the shirt can actually induce unsightly pull lines along the front and back of the shirt at the connection point when stressed. These pull lines again completely defeat the purpose of wearing such a garment. In addition, the positions of the bands when being worn can be uncomfortable. Finally, in many instances, the tails of the shirt will extend beyond the level of the wearer's crotch thus making the configuration depicted in FIG. 2 impossible to achieve for many users or result in a nonetheless sloppy and baggy shirt.

Figure 3:
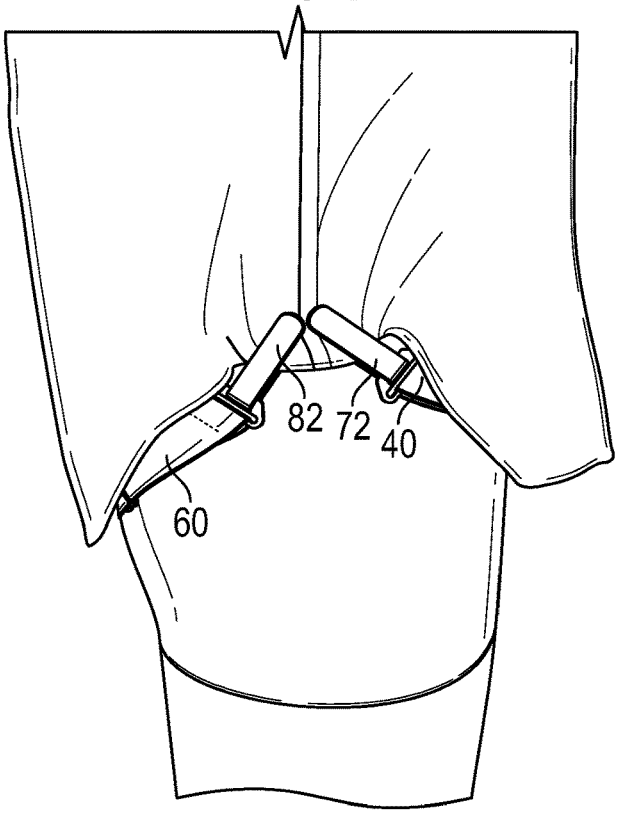
FIG. 3 is a side view of the undergarment of FIG. 1 as worn.

FIG. 3 depicts a side view of the undergarment 10 of the present disclosure as described with respect to FIG. 1 being worn. The connectors 72, 82 connect not to the front and rear of the shirt or blouse, but rather to the sides of the shirt or blouse. Though shown connected to the bottom of the shirt proximate the side seam on the exterior of the shirt, the instant disclosure is not so limited and the connectors 72,82 may be attached to the shirt, for example at the side seam, on an interior of the shirt. This may be particularly useful in instances where the shirt is longer that that depicted in FIGS. 3-7. Additionally or alternatively, and without departing from the scope of the disclosure, the undergarments (e.g., 10, 100, 200) of the instant disclosure may be secured not just to a shirt or a blouse as shown, but may be secured to another undergarment such as a tank top or a camisole to maintain those garments in place for the wearer.

Figure 4:
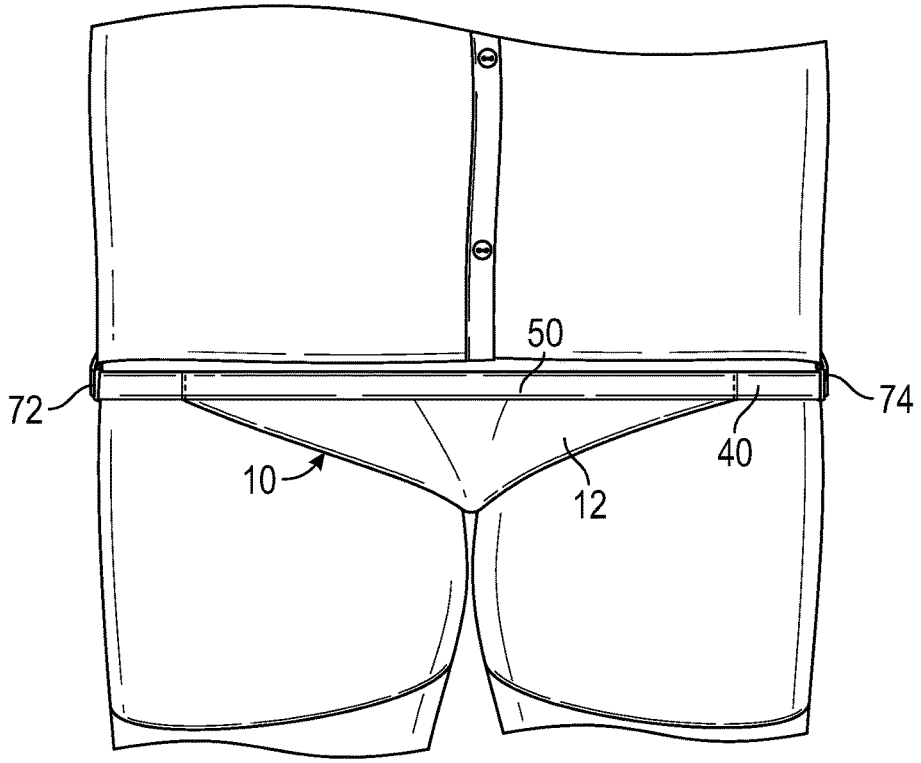
FIG. 4 is a front view of the undergarment of FIG. 1 as worn.

FIG. 4 depicts another aspect of the undergarment of the present disclosure related to the front view of the undergarment 10 as worn. As is clearly visible in this view, when properly worn, the elastic front band 40 of the front panel 12 extends directly outward from the front panel 12 along the line of the top part 14 and substantially parallel to the ground across the front of the top of the wearer's thigh at about the groin area. When extending in this parallel to the ground fashion, the soft tissues of that leg at about the groin area, in combination with the allow for the undergarment 10 to be substantially invisible to an observer when worn under pants or a skirt. As can be seen at the sides of the wearer the connectors 72, 74 are also substantially in line with the elastic front band 40.

Figure 5:
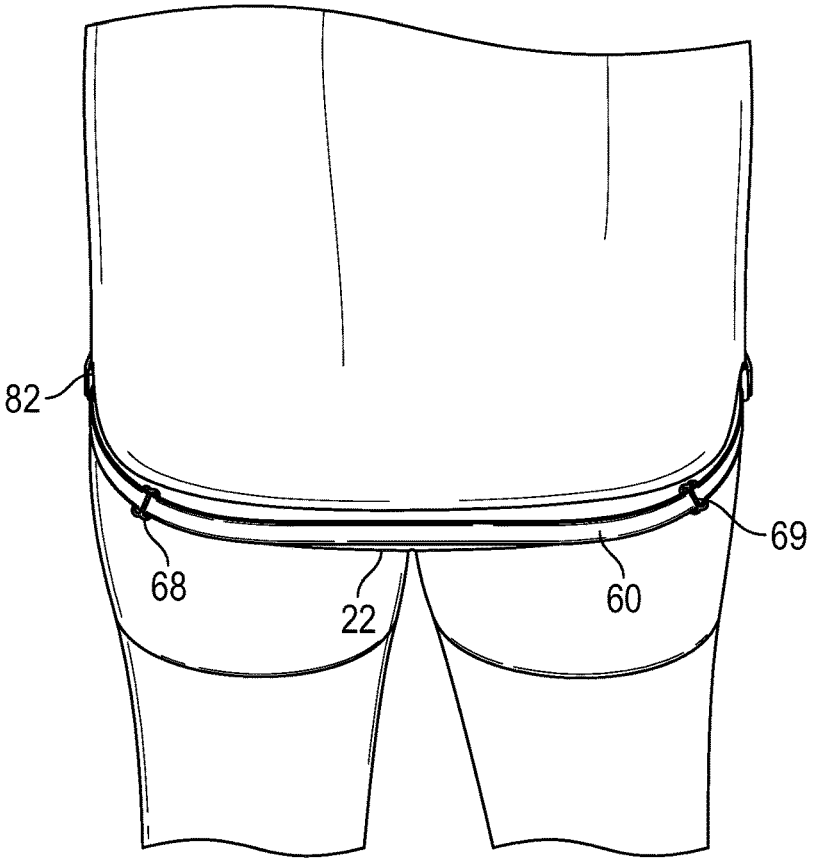
FIG. 5 is a rear view of the undergarment of FIG. 1 as worn.

FIG. 5 depicts a rear view of the undergarment 10 as worn. The rear elastic band 60 extends from the rear panel 22. The rear elastic band 60 extends outward from the top edge 26 and wraps under the wearer's buttocks at a position that generally would not be seen when under a skirt or pants. The rear elastic band 60 wraps around wearer's upper thigh and hip and connects to the shirt or blouse at the sides of the shirt or blouse. This connection point, as noted above, ensures that the sides of the shirt cannot be pulled beyond the waistband of a shirt or pants, and the elasticity of the bands 40, 60 in fact retract the shirt when any pressure applied to the shirt, and there with the bands 40, 60 is released.

Figure 6:
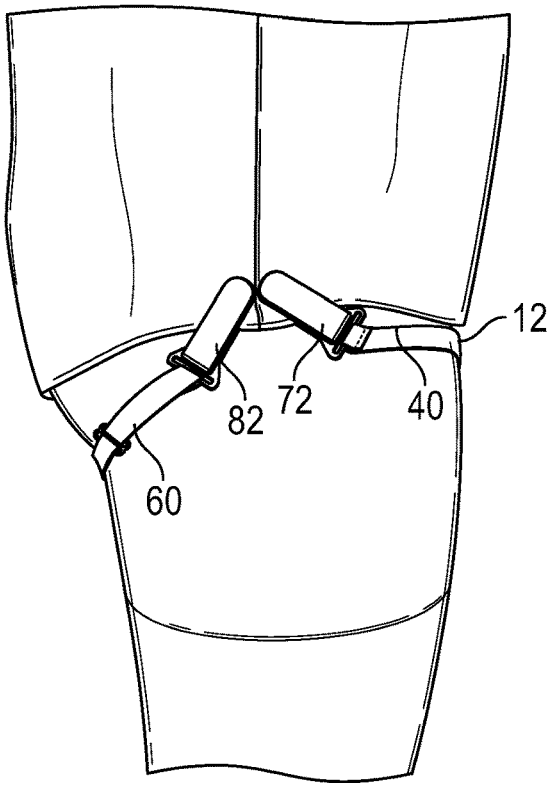
FIG. 6 is a side view of the undergarment of FIG. 1 depicting the connection to a side seam of a shirt and the path of the elastic bands on the body of the wearer.
Figure 7:
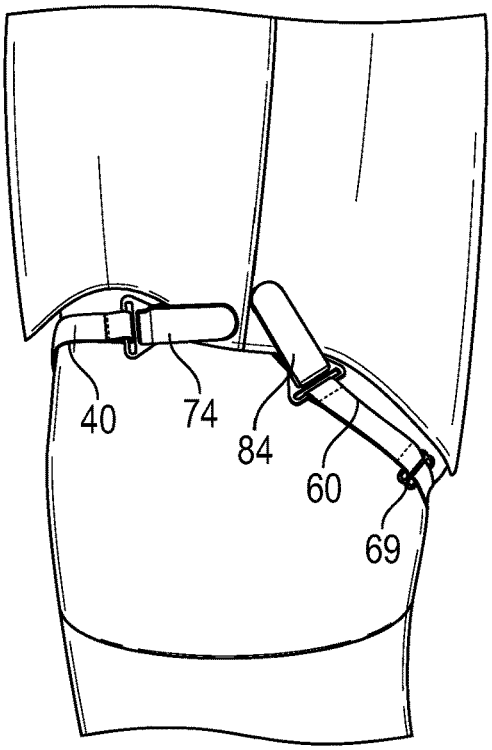
FIG. 7 a side view of the undergarment of FIG. 1 depicting the connection to a side seam of a shirt and the path of the elastic bands on the body of the wearer.

FIG. 6 depicts the same side view as FIG. 3 but with the shirt tails pulled up so as to expose the connection of the connectors 72, 82 and their connection to the shirt along the side seam of the shirt or blouse. FIG. 7 depicts the opposite side of the wearer and undergarment 10 with the shirt pulled up to reveal how the undergarment connects to the shirt or blouse and to observer the fit on the wearer.

Note that the front elastic band 40 is in all views sits in a substantially straight line across the wearer's thigh. This straight line and its location across the upper portion of the thigh proximate the groin render the band 40 substantially invisible when pants or a skirt are worn over the undergarment 10. In a similar fashion, the elastic back band 60, which lays flat and extends under the buttocks and along the side of the wearer will also be substantially unobservable when worn under a skirt or pants. In addition, because in most instances the shirt tails will actually be tucked into the skirt or pants to a point where the elastic bands 40, 60 are covered, further concealment is enabled by this design. Thus, the undergarment 10 when worn under pants or a skirt achieves a sleek and professional look that is discrete and essentially unobservable.

Figure 9:
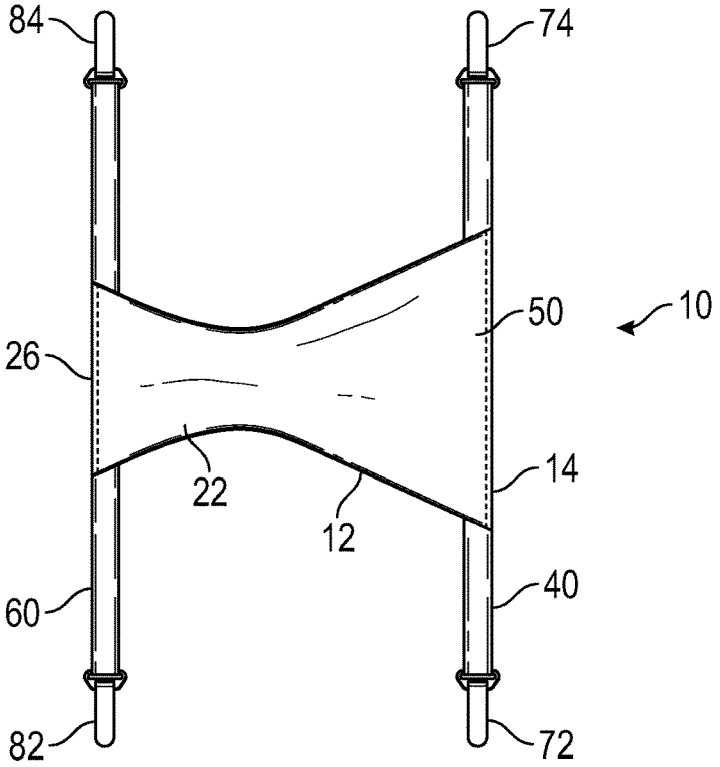
FIG. 9 is a plan view of an undergarment of one-piece undergarment in accordance with the disclosure.

Though FIG. 1 depicts an undergarment for women, the disclosure is not so limited. FIG. 8 depicts a one-piece undergarment 10 for men. The front panel 12 depicted in FIG. 8 is sized and shaped to accommodate the male genitalia. In one embodiment, the front panel forms a pouch, much like an athletic supporter to be comfortably worn by men. Other aspects the undergarment 10 for men are substantially the same as those described above. Further, though FIG. 8 depicts a one-piece device with no detachable connection 30, one of skill in the art will understand that incorporation of such a feature into the undergarment of FIG. 8 is within the scope of the disclosure. Indeed, as an alternative to the device of FIG. 1 having a two-piece construction, FIG. 9 depicts an undergarment 10 for women having a one-piece construction similar to the undergarment of FIG. 8 for men. Though not shown in FIG. 9, a gusset or opening may be formed in the undergarment to allow for the wearer to utilize the restrooms without needing to remove the undergarment. The gusset may include a closure mechanism of any of the types described herein (e.g., hook and loop, snaps, etc.).

Figure 10A:
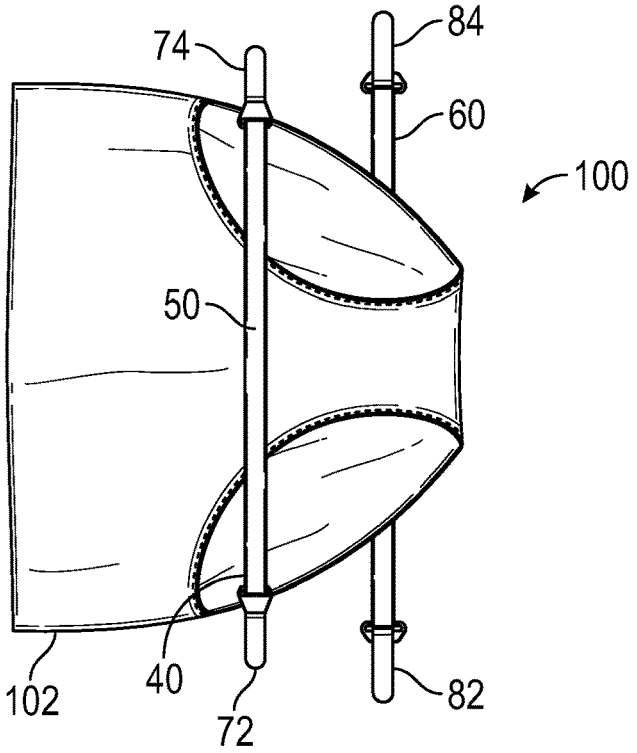
FIG. 10A is a front side view of a panty in accordance with a further aspect of the disclosure.
Figure 10B:
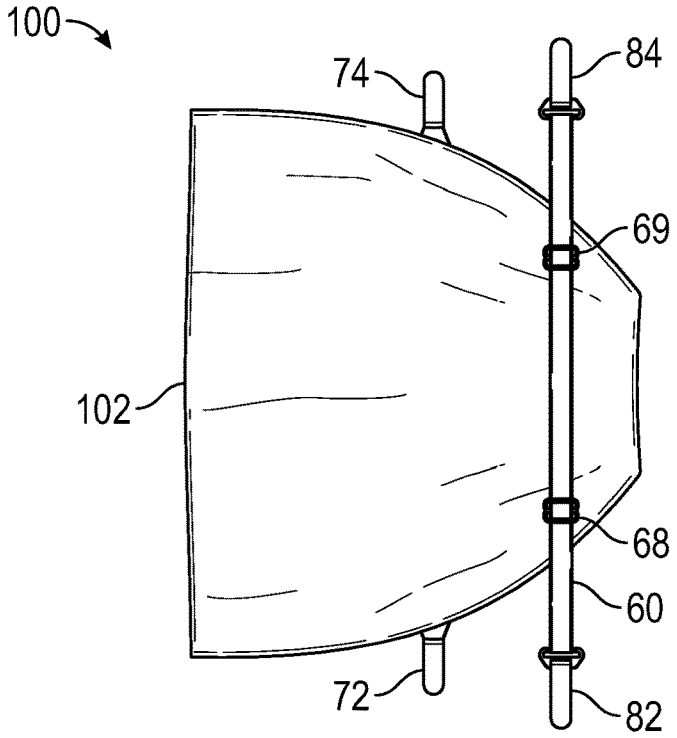
FIG. 10B is a back-side view of the panty in FIG. 10A.

FIGS. 10A and 10B depict a further aspect to the disclosure. Specifically, the aspects of the disclosure described above are directed to an undergarment 10 that is worn in addition to other underwear by the wearer. FIG. 10A depicts a front view of an undergarment 100 in which the features of the undergarment 10 are built into a traditional pair of women's underwear 102. The undergarment 100 includes a front elastic band 40 and a rear elastic band 60. The elastic bands 40 and 60 may optionally include all the features of the undergarment 10 described above with respect to FIG. 1, with the exception of the detachable connection 30 and the components associated with the detachable connection. FIG. 10B is a rear view of the undergarment 100. Though shown as a brief, undergarment 100 may take any form of undergarment including a thong, boxer, bikini, hanky panky, boy short, shape wear, bike shorts, and others as known to those in the undergarment industry. Further, though shown with two elastic bands 40 and 60 with four connectors 72-84, the undergarment 100 may include just two connectors located proximate an elastic band of the undergarment, similar to the embodiment depicted in FIGS. 11A and 11B. Further, though depicted in connection with elastic bands 40 and 60. In a further embodiment, the undergarment 100 may include a snap-systems with which a connector 72-84, or a connector as depicted in FIGS. 12A-12C can be secured to the undergarment 100 either near a top opening of the undergarment or along a side of the undergarment 100 such that the connector can be secured to a shirt of the wearer, as described elsewhere herein. Additionally or alternatively, the connector may be sewn to the undergarment 100 or ribbons may be sewn to the undergarment 100 with which a user may releasably tie the connector to the undergarment. In some embodiments multiple such ribbons may be sewn to the undergarment 100 such that the user could select the best location on the undergarment to secure the connector for use as described herein.

Figure 11A:
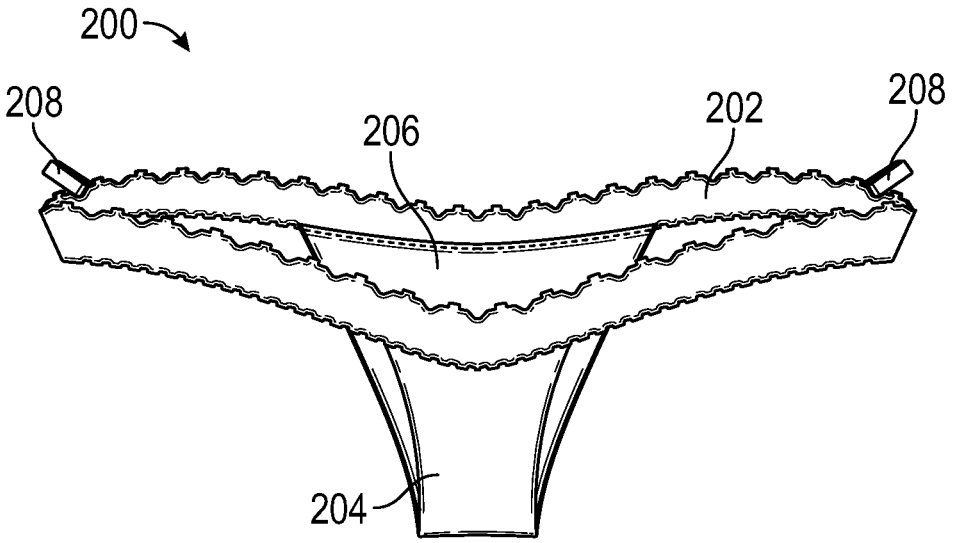
FIG. 11A is a front side view of an undergarment in accordance with the disclosure.
Figure 11B:
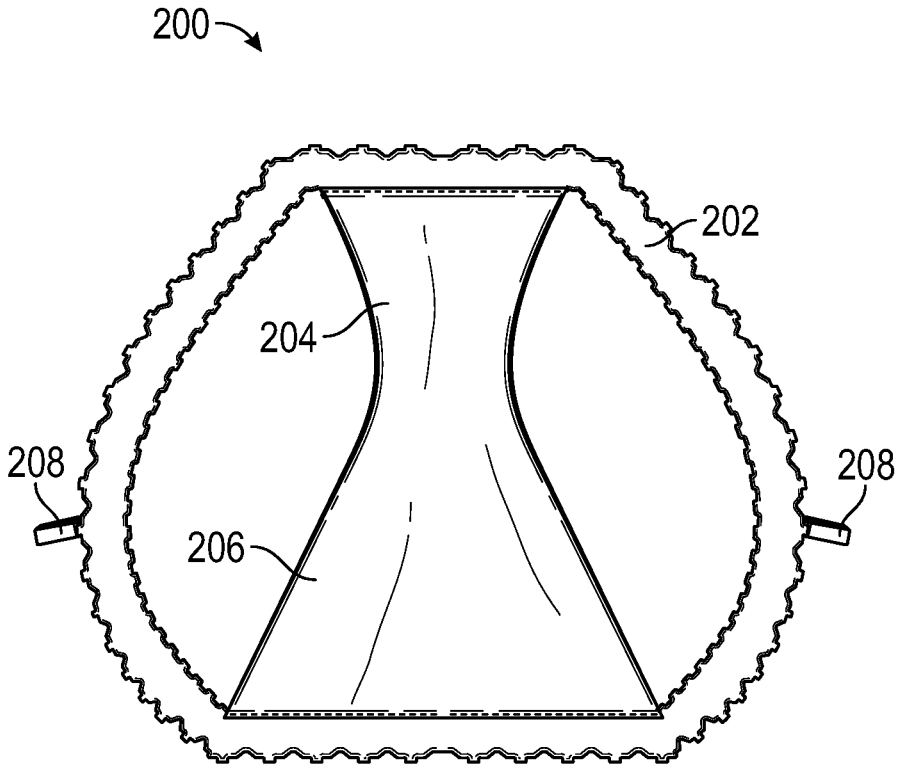
FIG. 11B is a top view of the undergarment of FIG. 11A.
Figure 12A:
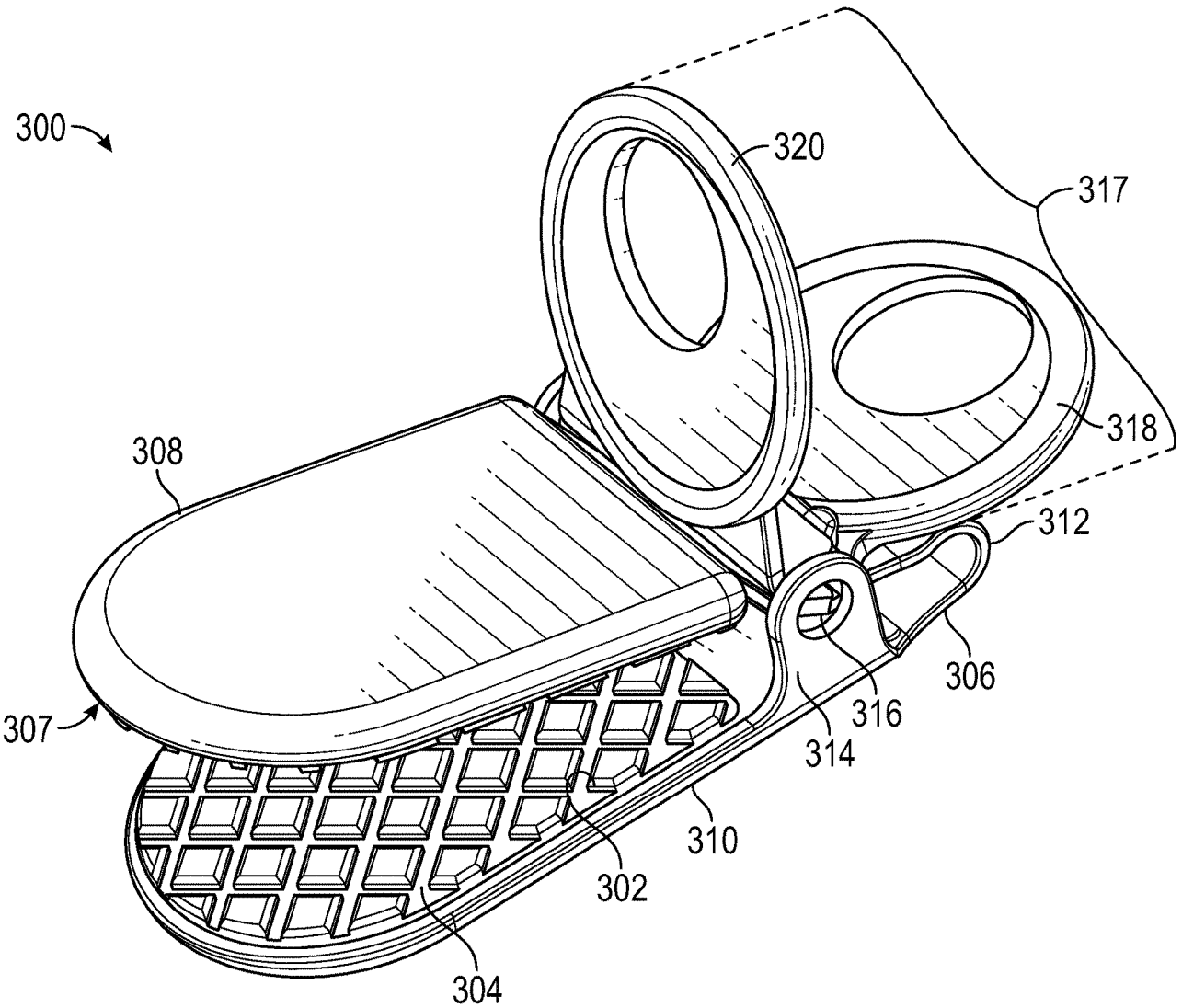
FIG. 12A is a perspective view of a connector in accordance with the present disclosure.
Figure 12B:
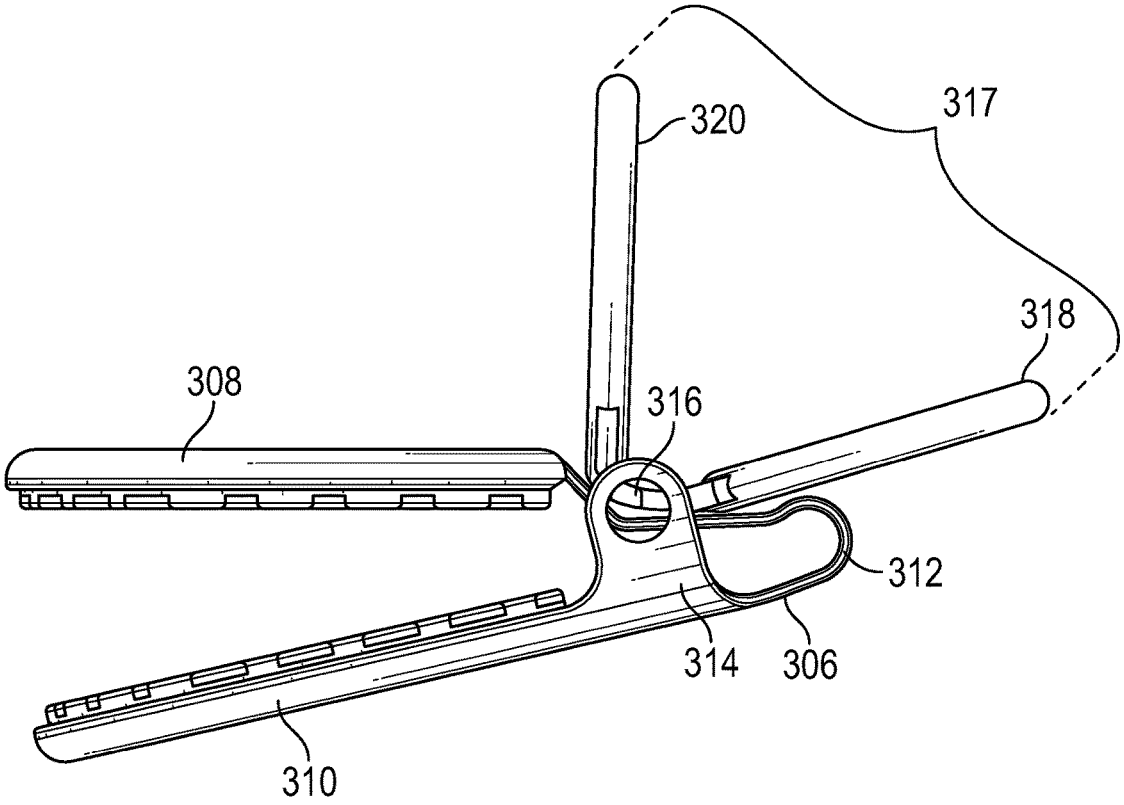
FIG. 12B is a side view of the connector in FIG. 12A in an open position.
Figure 12C:
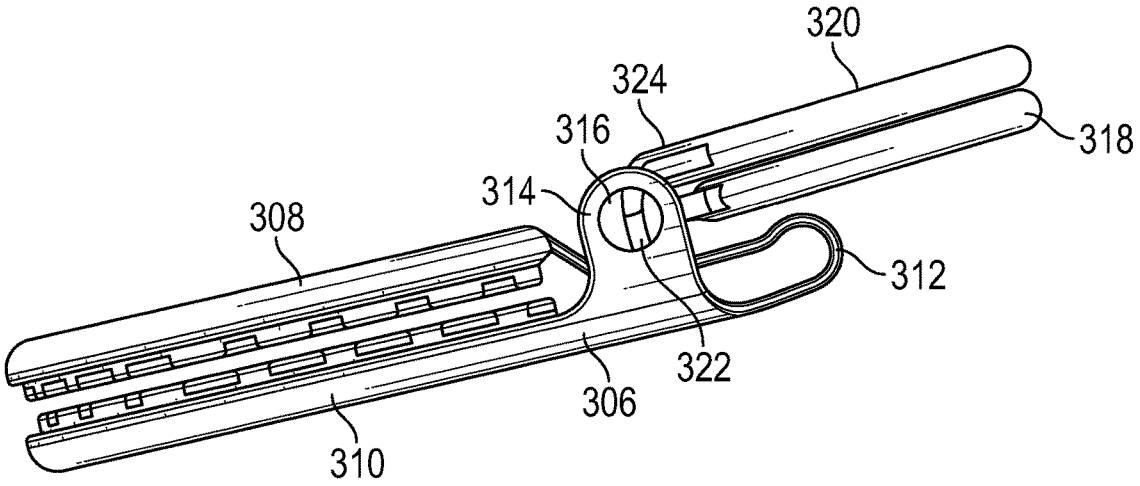
FIG. 12C is a side view of the connector in FIG. 12A in a closed position.

Still a further aspect of the disclosure is directed to an undergarment 200 as depicted in FIGS. 11A and 11B. As depicted in FIGS. 11A and 11B, the elastic band 202 is continuous and connects the front panel 204 and the rear panel 206. Unlike other embodiments described herein the undergarment 200 includes two connectors 208. Though one of ordinary skill in the art will recognize that the connectors 208 may be removable from the undergarment 200 and more than two may be connected to the elastic band 202 without departing from the scope of the present disclosure. This embodiment provides some additional advantages as well as including all of the advantages of the other embodiments.

One of the advantages of the embodiment of FIGS. 11A and 11B is that the wearer is able to don the undergarment as they would any other undergarment and place the undergarment on their body prior to attaching the connectors 208 to the wearer's shirt. This eases the process of putting on the undergarment 200. Once the undergarment 200 is in place on the body, the connectors 208 are connected to the side seams of the wearer's shirt. Because the connectors 208 are removable and may be placed at any location on the elastic band 202, the undergarment 200 is conformable to a wearer of different sizes who might have their side seams at different locations relative to the undergarment 200.

As worn, the undergarment 200 sits on the wearer's body similarly as shown with respect to undergarment 10 as depicted in FIGS. 4 and 5. The primary differences will be the continuous nature of the elastic band 202 and the single point of attachment by a connector 208 on each side of the wearer connecting the undergarment 200 to the side seams of the wearer's shirt. As with prior embodiments, the elastic band 202 will extend substantially horizontally across the front panel 204 and across the front of the wearer to the connectors 208 on the sides of the wearer. The elastic band 202 extends from the connector 208 to the rear panel 206 by traversing along the side of the wearer's hips. The rear panel 206 extends under the buttocks of the wearer and connect to the front panel 204. As with the configuration shown in FIG. 5, the rear panel 206 of the undergarment 200 and portions of the elastic band 202 remain below the buttocks and helps to maintain tension on the elastic band 202 and therewith the wearer's shirt where the connector 208 is attached thereto. Thought the undergarment 200 is shown with a lacy elastic band 202, the instant disclosure is not so limited and one of ordinary skill in the art will recognize that the elastic band can be straight, lacy, or other forms without departing from the scope of the disclosure.

One aspect of the disclosure that relates to all of the embodiments is the width of the elastic band 202, front elastic band 40 and rear elastic band 60. It is been determined that to further minimize the impingement of the elastic on the tissue of the wearer yet still remain effective, several factors need to be considered. To improve effectiveness, the elastic band must have at least a threshold modulus of elasticity but not too high a modulus of elasticity. Too low may be ineffective in securing the wearer's shirt, and too high results in impingement of the elastic band on the wearer, for example as the elastic band wraps around side and thigh of the wearer and reduce the mobility of the wearer. For example the modulus of elasticity may be between 20 and 60%, or between 30 and 50%, or about 40%, and any integer values of modulus within the stated ranges without departing from the scope of the disclosure at between 0.1-0.4 kg, or between 0.15-0.35 kg, or 0.285 kg (all values of kg are =/−25%).

Relatedly, the width of the elastic band can mitigate the effect of the modulus of elasticity by spreading the load caused by the elasticity over a wider portion of the wearer's body. Thus, in accordance with the present disclosure the elastic band may be between ½ inch and 3½ inches in width to spread the force applied by the elastic band on the wearer, and thus limit the impingement of the elastic band on the tissue of the wearer. The elastic bands 40, 60, and 200 may be ¼", ⅜", ½", ¾", 1", 1¼", 1½", 1¾", 2", 2¼", 2½", 2¾", 3", 3¼", or 3½" inches in width, or combinations thereof, without departing from the scope of the disclosure. Further, the widths of the elastic bands 40, 60, and 200 may be denominated in mm or cm dimensions and can be any integer value between 5 mm and 90 mm without departing from the scope of the disclosure.

In one example the elastic bands 40, 60, 200 of the undergarment is a woven including polyamide 74.5% and spandex 25.5% and includes the following specifications:

Total Width: 8 mm+/−0.5 mm
Weight/100 m 0.40 kg+/−8%
Elongation @ 4 kg 170+/−13%
Modulus @40% 0.285 kg+/−25%
Recovery >85%
Shrinkage <6%

Yet a further aspect of the disclosure is directed to a connector 300 as shown in FIGS. 12A-12C. The connector 300 may be implemented on any of the designs of the disclosure. The connector 300 is a double clasp type connector allowing removable connection to an undergarment and connection to a wearer's shirt, for example at the side seams. However, because of the removability of the connector 300 from the undergarment, the connector 300 may attach at any desired point of wearer's shirt to achieve the desired sleek and professional look that is discrete and essentially unobservable when worn under pants or a skirt.

The connector 300 includes two shirt clamping surfaces 302. These clamping surfaces 302 include a grid pattern 304 to increase holding ability when clamped to a shirt. The two clamping surfaces 302 are formed on a continuous metal band 306 that includes an upper shirt clamp half 308 and a lower shirt clamp half 310. A spring 312 is formed of a folded portion of the continuous metal band 306 and connects the upper shirt clamp half 308 and the lower shirt clamp half 310. Also formed on the lower shirt clamp half 310 is a strut 314 having a hole 316 formed therein. Mounted to the strut 314 is an undergarment clamp 317, The undergarment clamp 317 is composed of a lower undergarment clamp half 318 and an upper undergarment clamp half 320. The upper undergarment clamp half 320 is movably mounted in the hole 316, while the lower undergarment clamp half 318 is rigidly mounted to the strut 314. The upper undergarment clamp half 320 is biased in the hole 316 by a portion of the spring 312 acting on the underside of the upper undergarment clamp half 320. The upper undergarment clamp half 320 is rotatable within the hole 316 to move the undergarment clamp 317 from an open to a closed position.

FIG. 12B depicts the connector 300 in an open position. The upper undergarment clamp half 320 has been rotated in the hole 316 of the strut 314 to a position approximately perpendicular to the position of the lower undergarment clamp half 318. This movement alleviates the pressure applied by the upper undergarment clamp half 320 on the spring 312. Release of this pressure allows the spring 312 to return to form and allows the upper shirt clamp half 308 to move in the vertical direction as shown in the figure. That is, the upper shirt clamp half 308 moves in the direction of the upper undergarment clamp half 320.

FIG. 12C depicts the connector 300 in the closed position. To achieve this position from the position in FIG. 12B, the upper undergarment clamp half 320 is rotated in the direction of the lower undergarment clamp half 318. A tang 322 which extends at an angle from a main portion 324 of the upper undergarment clamp half 320 impacts a portion of the upper shirt clamp half 308 proximate the spring 312 and forces the upper shirt clamp half 308 in the direction of the lower shirt clamp half 310. Once the tang 322 rotates in the hole 316 to about perpendicular to the portion of the upper shirt clamp half 308, the upper shirt clamp half 308 and the lower shirt clamp half 310 are forced to a position where the clamping surfaces 302 proximate to one another and in a position where the clamping surfaces 302 contact each other, or are at least sufficiently proximate each other to secure the connector 300 to a wearer's shirt. The action of the upper undergarment clamp half 320 in the direction of the lower undergarment clamp half 318 closes the undergarment clamp 317 and puts the two clamp halves 320 and 318 in the closed position where they clamp a portion of the elastic band (e.g., elastic band 202 in FIG. 11A).

The connector 300 has several advantages over known connectors. Among those advantages are that the connector 300 can be placed on the undergarment (10, 100, 200) at any location. Further, if a wearer requires or desires additional support, additional connectors 300 can be added to the undergarment. Still further, the connector 300 may be easily removed to allow for care and maintenance of the undergarment.

While several aspects of the disclosure have been shown in the drawings, it is not intended that the disclosure be limited thereto, as it is intended that the disclosure be as broad in scope as the art will allow and that the specification be read likewise. Therefore, the above description should not be construed as limiting, but merely as exemplifications of particular aspects of the disclosure.

What is claimed is:

1. An undergarment comprising:

a front panel having a top edge;

an elastic band stitched to the front panel along the top edge, the elastic band extending beyond the front panel parallel to the top edge;

a back panel having a top edge the elastic band stitched to the back panel along the top edge of the back panel and extending beyond the back panel parallel to the top edge, wherein the front panel has a greater length perpendicular to the top edge than the back panel; and at least two connectors secured the elastic band and configured to attach to a side seam of a blouse or shirt.

2. The undergarment of claim 1, wherein the elastic band extends from the front panel and across a thigh of a wearer substantially parallel to the top edge of the front panel.

3. The undergarment of claim 1, wherein elastic band extends from the back panel and under the buttocks of a wearer.

4. The undergarment of claim 1, further comprising a connection point, where the front and back panels connect to each other.

5. The undergarment of claim 1, wherein the front and back panels are integrally formed in a one-piece construction.

6. The undergarment of claim 1, wherein the front panel is shaped to receive male genitalia.

7. The undergarment of claim 1, wherein the elastic band is formed of a first elastic band extending from the front panel and a second elastic band extending from the back panel.

8. The undergarment of claim 1, wherein each of the first and second elastic bands includes at least one length adjuster.

9. The undergarment of claim 1, wherein the front and back panels are configured for placement between the legs of a wearer.

10. The undergarment of claim 9, wherein the front and back panels have a substantially trapezoidal shape.

11. The undergarment of claim 9, wherein the front and back panels are integrally formed in a substantially hourglass shaped one-piece construction.

12. The undergarment of claim 1, wherein the connectors are clasp type connectors.

13. The undergarment of claim 12, wherein the connectors are double clasp type connector.

14. The undergarment of claim 13, wherein a first clasp is configured to be secured to a shirt, and a second clasp is configured to be secured to the elastic band.

15. The undergarment of claim 14, wherein closure of the first clasp simultaneously closes the second clasp.

16. An undergarment comprising:

a front panel having a top edge;

an elastic band stitched to the front panel along the top edge, the elastic band extending beyond the front panel parallel to the top edge;

a back panel having a top edge the elastic band stitched to the back panel along the top edge of the back panel and extending beyond the back panel parallel to the top edge, wherein the front panel has a greater length perpendicular to the top edge than the back panel; and at least two dual clasp connectors secured the elastic band and configured to attach to a side seam of a blouse or shirt, and including, a continuous band clamp including an upper shirt clamp half, a lower shirt clamp half and a spring;

an undergarment clamp including an upper undergarment clamp half and a lower undergarment clamp half;

a strut formed on the continuous band clamp and configured to rigidly support the lower undergarment clamp half and to receive the upper undergarment clamp half in a hole formed in the strut; and a tang extending from the upper undergarment clamp half, wherein rotation of the upper undergarment clamp half in the hole in a direction towards the lower undergarment clamp half forces the tang against the upper shirt clamp half forcing the upper shirt clamp half in the direction of the lower shirt clamp half closing the continuous band clamp and the undergarment clamp.

17. The undergarment of claim 16, wherein the elastic band extends from the front panel and across a thigh of a wearer substantially parallel to the top edge of the front panel.

18. The undergarment of claim 16, wherein elastic band extends from the back panel and under the buttocks of a wearer.

19. The undergarment of claim 16, wherein the front and back panels are integrally formed in a one-piece construction.

20. An undergarment comprising:

a front panel having a top edge, the front panel configured to be worn across the front of a wearer;

a back panel having a top edge, the back panel being integrally formed with the front panel, wherein the front panel has a greater length perpendicular to the top edge than the back panel and the back panel extends to a point under the wearer's buttocks;

a single continuous elastic band stitched to the front panel along the top edge and stitched to the back panel along the top edge of the back panel; and at least two connectors secured the elastic band and configured to attach to a side seam of a blouse or shirt;

wherein the elastic band extends from the front panel parallel to the top edge to a point on each side of the wearer where the at least two connectors are secured, and the elastic band further extends from the top edge of the back panel parallel to the top edge, under the buttocks of the wearer and to the point where the at least two connectors are secured.

* * * * *